US007565941B2

(12) United States Patent
Cunningham

(10) Patent No.: US 7,565,941 B2
(45) Date of Patent: Jul. 28, 2009

(54) MOTORIZED VEHICLE

(76) Inventor: John P. Cunningham, P.O. Box 7146, Charleston, WV (US) 25356

( * ) Notice: Subject to any disclaimer, the term of this patent is extended or adjusted under 35 U.S.C. 154(b) by 72 days.

(21) Appl. No.: 11/078,722

(22) Filed: Mar. 14, 2005

(65) Prior Publication Data

US 2005/0230163 A1 Oct. 20, 2005

Related U.S. Application Data

(60) Provisional application No. 60/552,749, filed on Mar. 15, 2004, provisional application No. 60/552,750, filed on Mar. 15, 2004.

(51) Int. Cl.
*B60T 7/16* (2006.01)

(52) U.S. Cl. ..... 180/167; 180/65.1; 180/89.1

(58) Field of Classification Search ..... 180/167, 180/89.12; 89/36.07–36.09
See application file for complete search history.

(56) References Cited

U.S. PATENT DOCUMENTS 2,918,738 A * 12/1959 Barr ..... 37/347
4,524,674 A * 6/1985 Gilvydis ..... 89/36.08
4,600,069 A * 7/1986 Oswald et al. ..... 180/24.02
4,648,305 A * 3/1987 Elspass ..... 89/36.08
4,714,140 A * 12/1987 Hatton et al. ..... 180/20
4,769,700 A * 9/1988 Pryor ..... 348/120
5,158,146 A * 10/1992 Fuller ..... 175/122
5,622,235 A * 4/1997 Merritt ..... 180/9.42
5,727,481 A * 3/1998 Voorhees et al. ..... 110/237
5,830,752 A * 11/1998 Bruso ..... 435/283.1
5,836,398 A * 11/1998 White ..... 169/24
5,936,185 A * 8/1999 Tokuni ..... 89/1.13
5,974,348 A * 10/1999 Rocks ..... 701/28
6,029,750 A * 2/2000 Carrier ..... 169/52
6,102,469 A * 8/2000 Shambeau et al. ..... 296/184.1
6,282,477 B1 * 8/2001 Gudat et al. ..... 701/50
6,435,071 B1 * 8/2002 Campbell ..... 89/36.08
6,443,490 B2 * 9/2002 Webb ..... 280/765.1
6,619,177 B1 * 9/2003 Hansen et al. ..... 89/1.13
6,621,764 B1 * 9/2003 Smith ..... 367/128
6,798,343 B2 * 9/2004 Carrier et al. ..... 340/539.13
6,862,509 B2 * 3/2005 Rau et al. ..... 701/50
7,086,318 B1 * 8/2006 Dárnall ..... 89/1.815

* cited by examiner

*Primary Examiner*—Christopher P Ellis
*Assistant Examiner*—Katy Meyer
(74) *Attorney, Agent, or Firm*—Jean C. Edwards, Esq.; Akerman Senterfitt

(57) ABSTRACT

A motorized vehicle includes a vehicle body having a rigid frame in a shape of a tractor; and a plurality of audio and visual devices disposed on the vehicle body, including a camera. The vehicle can be remote-controlled, and the vehicle body may be armored and may include a weapon system. The camera may be one of a motion, thermal, digital, and near infrared camera, and may be retractable into a housing. In another embodiment, the motorized vehicle, which may be remote-controlled, includes a vehicle body having a rigid frame in a rectangular shape with sloped sides; at least one storage unit accessed by doors, disposed within the vehicle body; and a camera disposed on the vehicle body.

19 Claims, 6 Drawing Sheets

MOTORIZED VEHICLE

CROSS-REFERENCE TO RELATED APPLICATIONS

This application claims priority from U.S. Provisional Application No. 60/552,749 filed Mar. 15, 2004, and U.S. Provisional Application No. 60/552,750 filed Mar. 15, 2004, the contents of both documents which are herein incorporated by reference in their entirety.

BACKGROUND OF THE INVENTION

1. Field of the Invention

The present invention relates to a motorized vehicle which can be used in all terrains and for various types of activities, including military tasks, and which can be remote controlled and adapted to include a plurality of useful attachments.

2. Description of the Related Art

Motorized vehicles used for all terrains and for military use, are known. However, vehicles which are used as supply, equipment and personnel carriers, which are weaponized, and which perform specific functions such as bomb detection or landmine clearance, are not known. Further, since the costs of personnel carriers, supply vehicles, and landmine clearance vehicles are high, and the possibility of damage or loss of these vehicles is also high, it is increasingly prohibitive to manufacture such vehicles due to the elevated cost of repair and replacement.

Accordingly, a motorized vehicle which can be used for supplies, materiel, personnel, and which can perform various specific functions, such as landmine or bomb clearance, and which can be remote controlled, and also, which is inexpensive to build and maintain, is highly desired.

SUMMARY OF THE INVENTION

The present invention relates to a motorized vehicle including a vehicle body having a rigid frame in a shape of a tractor; and a camera disposed on the vehicle body.

In one embodiment, the camera is one of a motion, thermal, digital, and near infrared camera. The camera may be retractable into a housing.

In another embodiment, the vehicle body is armored.

In yet another embodiment, the vehicle includes means for remote controlling the vehicle.

In yet another embodiment an antenna is disposed on the vehicle body, and the antenna includes a GPS system.

In yet another embodiment, the vehicle includes a control system to control the vehicle.

In yet another embodiment, the remote control means can place the vehicle in an autonomous mode.

In yet another embodiment, strap down rings are disposed on the vehicle body, to fasten the vehicle in place.

In yet another embodiment, an outrigger assembly is disposed on the vehicle body, to provide stabilization and rigidity to the vehicle when halted.

In yet another embodiment, a sensor is disposed on the vehicle body.

In yet another embodiment, a reflector is disposed on the vehicle body.

In yet another embodiment, a weapon system is disposed on the vehicle body.

In yet another embodiment, a PA system is disposed on the vehicle body.

In yet another embodiment, an alarm is disposed on the vehicle body.

In yet another embodiment, a backhoe/loader is disposed on the vehicle body.

In yet another embodiment, a control panel allows a user to access the control system.

In yet another embodiment, the vehicle includes an HVAC system.

In yet another embodiment, the vehicle body includes clamps for air transport.

In yet another embodiment, a motorized vehicle includes a vehicle body having a rigid frame in a shape of a tractor; a plurality of audio and visual devices disposed on the vehicle body; and means for remote-controlling the vehicle and the audio and visual devices.

In yet another embodiment, a motorized vehicle includes a vehicle body having a rigid frame in a rectangular shape with sloped sides; at least one storage unit accessed by doors, disposed within the vehicle body; and a camera disposed on the vehicle body.

There has thus been outlined, some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

DESCRIPTION OF THE INVENTION

The present invention relates to a motorized vehicle which can be manually or remote-controlled, and used for a variety of purposes in both military and non-military environments. The vehicle of the present invention may be used in a military environment for purposes such as patrols, landmine or bomb clearance, and tactical support, and can be used in non-military environments such as expeditions, where the vehicle provides a convenient way to carry equipment, supplies, and personnel, over all type of terrains, containing a variety of useful equipment which can assist the user.

Various embodiments of the vehicle of the present invention can be implemented to achieve the desired objectives. Although a number of different shapes and features of the vehicle of the present invention can be realized, as an example, two embodiments of the present invention are described as follows.

Figure 1A:
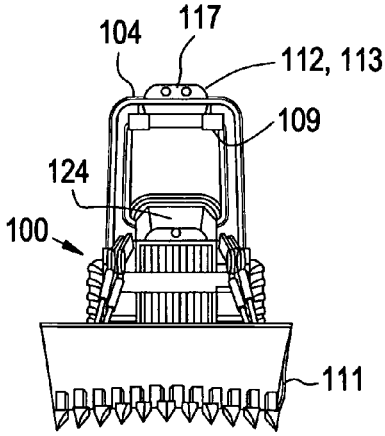
FIG. 1A is a front view of a first embodiment of the vehicle of the present invention, showing a backhoe/loader attachment.
Figure 1B:
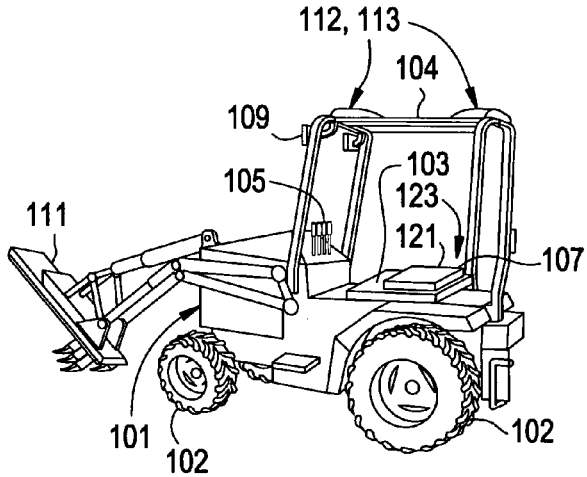
FIG. 1B is a side view of FIG. 1A.
Figure 2A:
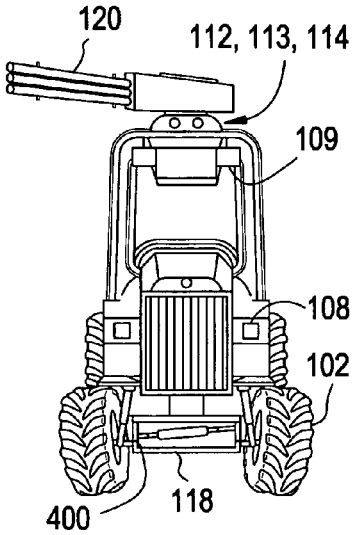
FIG. 2A is a front view of an alternate representation of a first embodiment of the vehicle of the present invention, showing a rotary cannon on the roof of the vehicle.
Figure 2B:
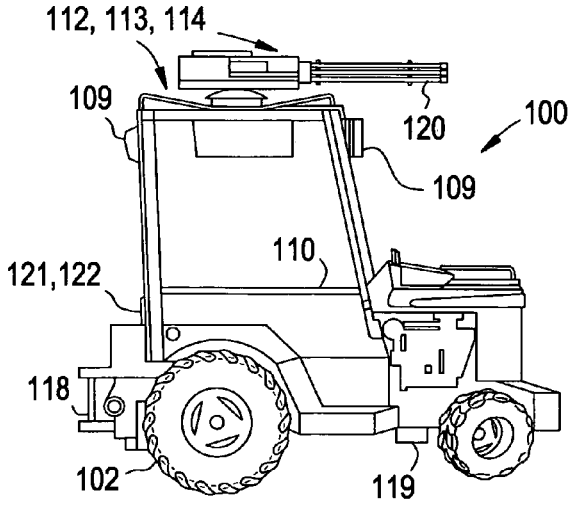
FIG. 2B is a side view of FIG. 2B.
Figure 3A:
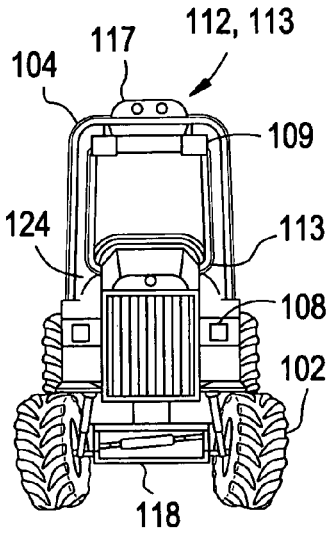
FIG. 3A is a front view of yet another alternate representation of a first embodiment of the vehicle of the present invention.
Figure 3B:
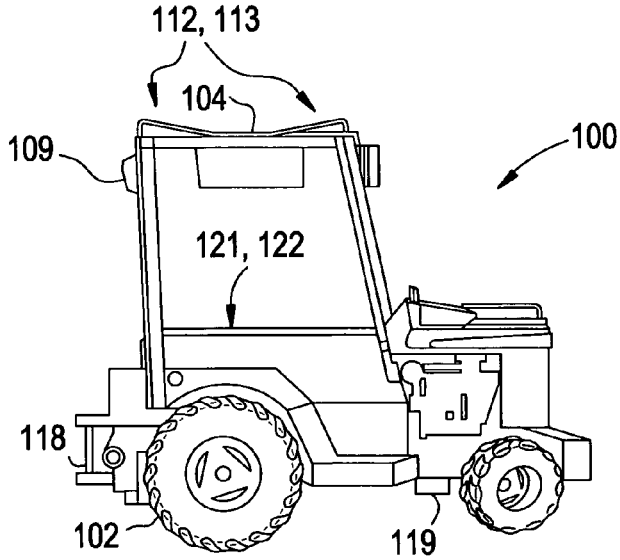
FIG. 3B is a side view of FIG. 3A.
Figure 4:
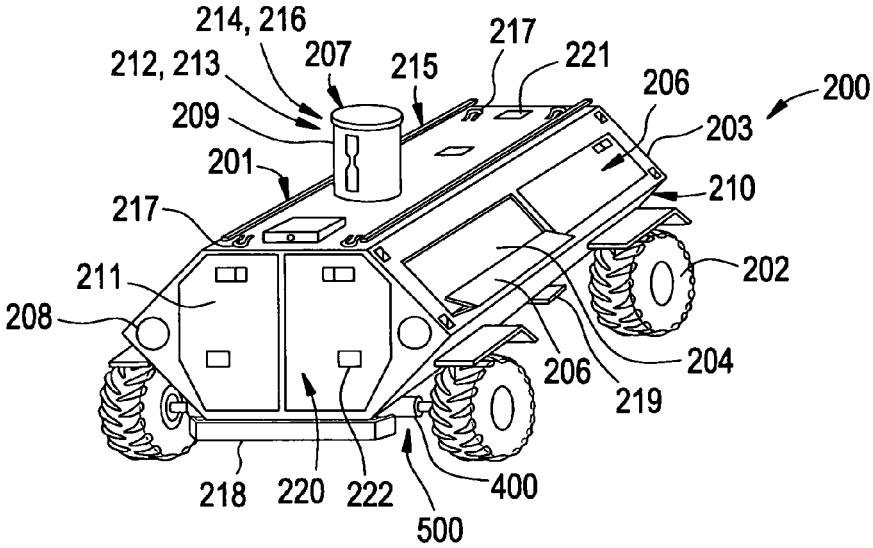
FIG. 4 is a perspective view of a second embodiment of the vehicle of the present invention.

FIGS. 1-3 show one embodiment of the present invention, with each of FIGS. 1-3 including different features with respect to alternate implementations of this embodiment. FIG. 4 shows a second embodiment of the present invention, which includes similar features as shown in FIGS. 1-3, and additional features thereof. However, one of ordinary skill in the art would recognize that each of the features of the embodiments described herein, may be interchanged without departing from the spirit and scope of the present invention, and that further modifications can be made to the invention as desired.

The vehicle 100 (see FIGS. 1-3) and 200 (see FIG. 4) of the present invention includes a body 101, 201, respectively, which is made of a rigid frame and formed in a simple shape, such as that of a tractor-shape (see FIGS. 1-3) or a rectangular shape (see FIG. 4), although the overall shape can be modified for a variety of purposes or to achieve a particular desired design.

The vehicle body 101, 201 includes a frame made from a hard material which provides sturdiness and rigidity to the body—for example, 5/16 inch to 1 inch steel. The frame can be made of a series of weldments, which allow the performance components to be bolted into place to provide strength, protection of all components, and ease of replacement when modifications are made.

Figure 5:
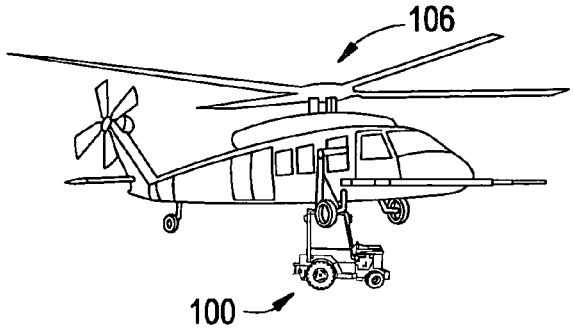
FIG. 5 is a perspective view of a first embodiment of the vehicle of the present invention being lifted by an air transport.
Figure 6:
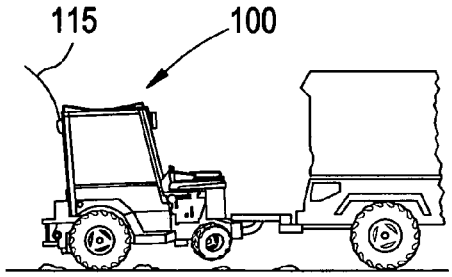
FIG. 6 is a side view of a first embodiment of the vehicle of the present invention being towed.
Figure 7:
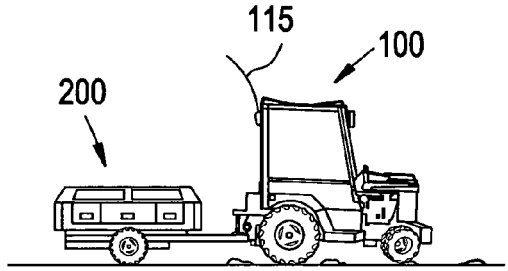
FIG. 7 is a side view of a first embodiment of the vehicle of the present invention towing the second embodiment of the present invention.
Figure 8:
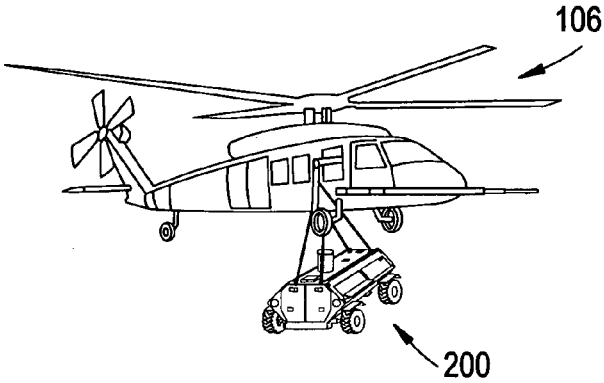
FIG. 8 is a perspective view of a second embodiment of the vehicle of the present invention being lifted by an air transport.

When the frame is that of a tractor-shape, it can also include an overhead canopy (open or closed) 104 (see FIGS. 1-3), also made from steel, for example, for additional strength and stabilization, and to provide a base for attaching a clamp for air transport—by a helicopter 106, for example (see FIG. 5).

The frame can also be strengthened by adding appliqué armor 110, 210 to the frame of the vehicle 100, 200. In addition, specific protection to various parts of the vehicle 100, 200 can be provided, such as a cover (also made of steel, for example) for radiator protection 124 (see FIGS. 1 and 3).

The vehicle 100, 200 of the present invention is motorized and may include a turbo-charged engine, or a turbo-charged diesel engine, whose engine block is made of cast iron, or even a hybrid engine or an electric motor. Thus, the vehicle 100, 200 may run on gasoline or diesel fuel, or any other suitable hybrid fuel—including being modified to be an electric vehicle 100, 200. Further, the vehicle 100, 200 may include larger fuel and oil tanks to be able to be run longer than an equivalent-sized commercial vehicle.

In one embodiment consistent with the present invention, the vehicle 100, 200 would include hydrastatic power steering for ease of movement, and would have a two front wheel drive (2WD) axle assembly or 4 wheel drive (4WD) axle assembly, including a rigid rear wheel drive axle with track lock assembly.

The front and rear tires 102, 202 may be air or solid filled tires, which can be used in a variety of terrain, such as mud, sand, aggressive mud, and urban environments, and which provide high shock absorption, cushioning, and durability. The choice of tire should also be such that it can provide a certain tractive effort, anti-skid ability, and can provide a minimum predetermined vehicle gradebility percentage at rolling resistance over concrete, mud, and sand, for example.

In one embodiment consistent with the present invention, the tractor-shaped body 101 includes at least one seat 103 with an adjustable slide track, for use by a user when the vehicle 100 is manually or cable (see FIG. 1 for cable system 123), but not radio/remote-controlled (see FIGS. 1-3). Manual controls 105 may be situated at the front of the interior of the vehicle 100.

Figure 10:
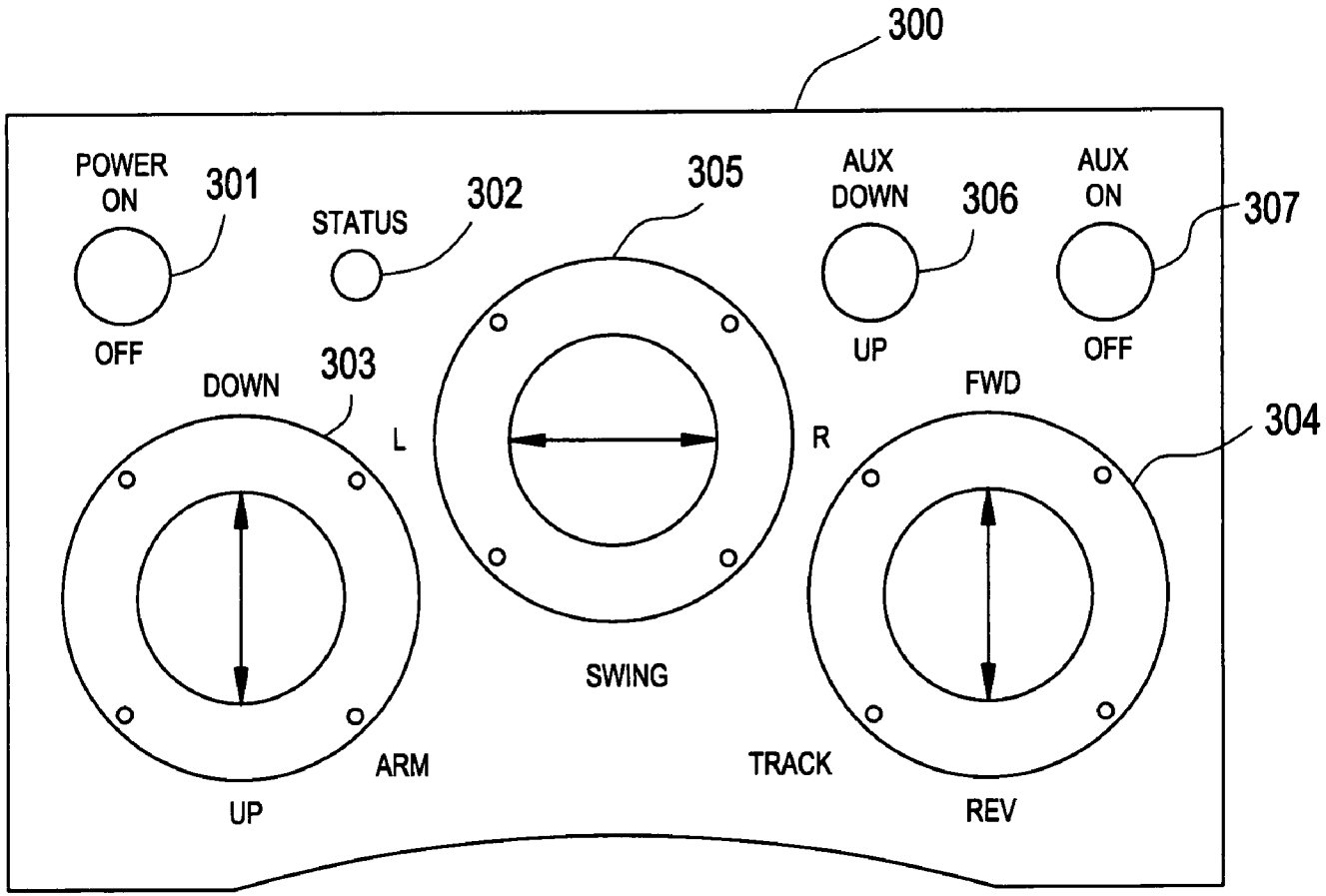
FIG. 10 is an exemplary control panel of the vehicle of the present invention.
Figure 11A:
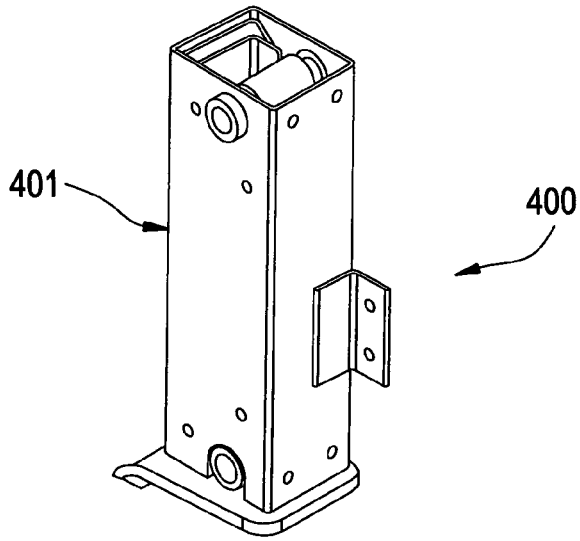
FIG. 11A is a perspective view of one embodiment of an outrigger assembly in a closed position, according to one embodiment consistent with the present invention.
Figure 11B:
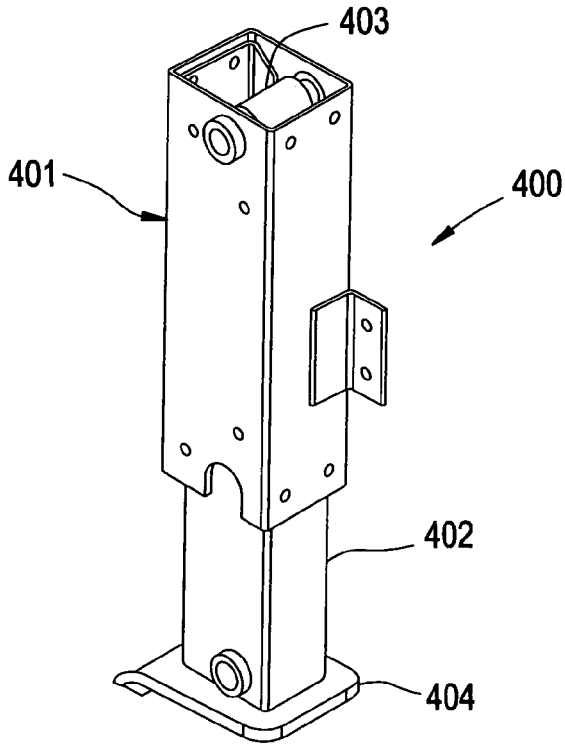
FIG. 11B is a perspective view of the embodiment of FIG. 11A, with the outrigger assembly in an extended position, according to one embodiment consistent with the present invention.
Figure 12A:
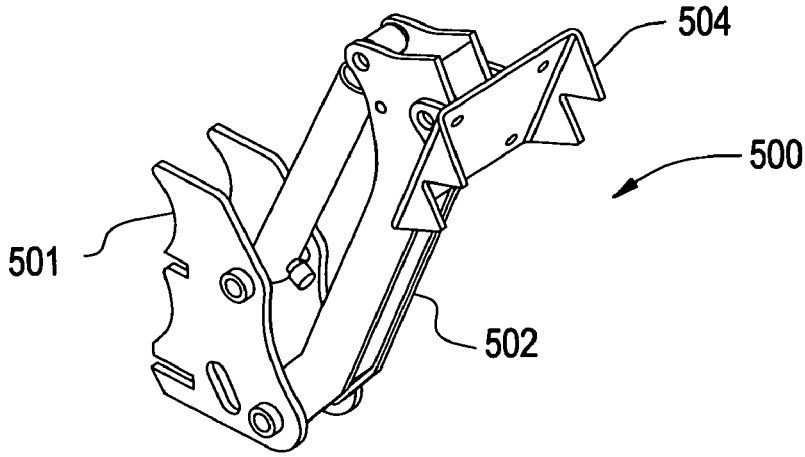
FIG. 12A is a perspective view of another embodiment of an outrigger assembly in a closed position, according to one embodiment consistent with the present invention.
Figure 12B:
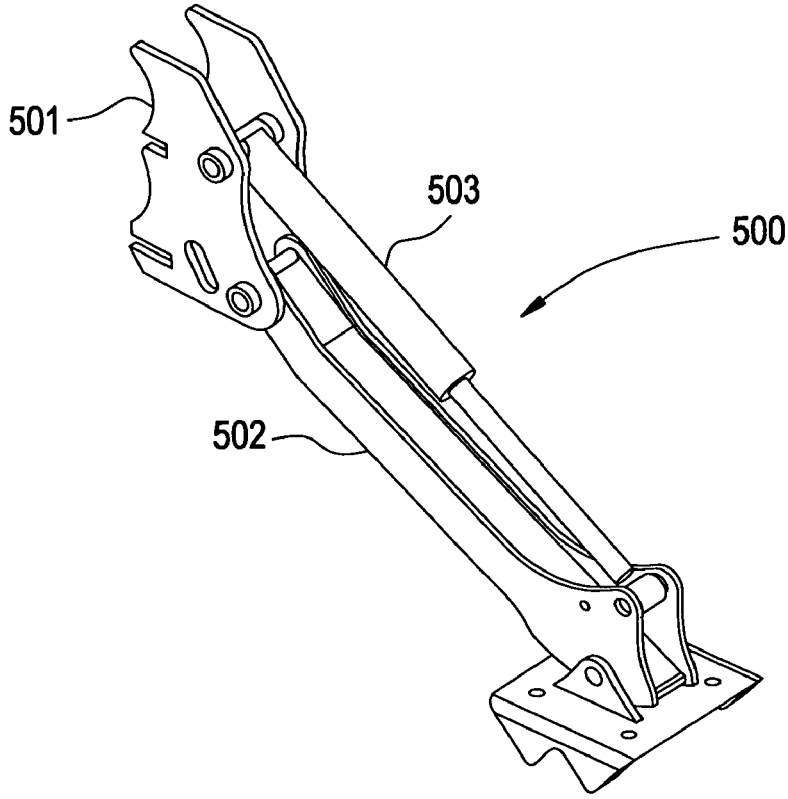
FIG. 12B is a perspective view of the embodiment of FIG. 12A, with the outrigger assembly in an extended position, according to one embodiment consistent with the present invention.

An exemplary control panel 300 of the vehicle 100, 200 is shown in FIG. 10. The control panel 300 shows the power button 301, status button 302, arm control 303, track control 304, swing control 305, and auxiliary up and down switch 306, as well as auxiliary on and off button 307. However, one of ordinary skill in the art would know that other status buttons or control buttons for the status or control of any system in the vehicle 100, 200, may be provided as desired by the user.

In at least one embodiment of the present invention, a control system controls the motor and hydraulic system of the vehicle 100, 200. For example, a proportional controller allows a complete, single component interface, and eliminates the need for multiple solenoid driver cards, power supplies, amplifiers, or expensive specialty solenoid valves. The controller is compatible with a wide range of input devices, such as potentiometers, transducers, switches, etc. The controller can be connected to analog proportional inputs (i.e., joystick or potentiometer), or digital switch/joystick inputs, with corresponding digital and proportional outputs which support a wide range of hydraulic circuits.

In one embodiment consistent with the present invention, the vehicle 100, 200 will include a hydrastatic transmission rated for 35 HP, for example, hydraulic motors rated for 40

HP, for example, and hydraulic valves that withstand 3,500 PSI and flow rates of 25 GPM, for example.

The vehicle 100, 200 may be remote-controlled by a user, using radio remote controls 107, 207 as means for remote control, which may operate in the 902-928 MHz band in the United States, or in the 2.4 GHz ISM band internationally, such as a multi-function radio remote control, for example. The frequency hopping spread spectrum (FHSS) technology and field selectable channel/address switches allow multiple radio controls to be used in the same area without crosstalk or interference. The range of communication is approximately 1500 feet or 500 feet line-of-sight, for example. The remote control 107, 207 can be placed in any suitable position in or on the body 101, 201 of the vehicle 100, 200.

In one embodiment consistent with the present invention, the transmitter of the radio remote control 107, 207 may be enclosed in a pack suitable for demanding environments. A plurality of controls for the remote control 107, 207 are available from standard to environmentally sealed hall-effect joysticks, or standard to MIL-SPEC toggle switches, paddles and dials. The power source for the remote control 107, 207 can be either rechargeable "C" cell batteries or standard alkaline batteries, for example. The transmitter and receiver of the remote controls 107, 207 can also be provided together in the event radio communication is lost or the transmitter batteries are spent.

In one embodiment consistent with the present invention, the receiver of the radio remote control 107, 207 may be mounted in a NEMA 4 hinged metal panel 106, or a fiberglass enclosure, for example. An environmentally sealed metal circular connector may be provided for power and field wiring. A variety of standard output types can be selected for use with the desired hydraulic/pneumatic system and other machine control components. Digital outputs can be configured for latching or momentary operation. Proportional and radiometric outputs may feature adjustable minimum and maximum scaling, and adjustable ramp up and ramp down times. An adjustable dither signal can be provided to ensure fine control over a narrow range. The antenna can be built-in or external, to suit any application.

The vehicle 100, 200 can be placed in autonomous mode such that the user does not have to be actively controlling every movement of the vehicle 100, 200, which is particularly useful for patrolling purposes and surveillance purposes.

The vehicle 100, 200 when under remote control, may have a wheel RPM of approximately 193.3 (based on maximum walking speed an set by valve spooling), for example, and an approximate speed of 4.1 mph (limited by spool in valve and not pump displacement), for example. However, one of ordinary skill in the art would know to change these statistics as appropriate for the desired environment. Tractive effort may be about 2589 lbf in one embodiment, as desired. Further, vehicle gradability percentage at rolling resistance may be 2% on concrete with a 36.1% grade, for example, 10% with a 30.6% grade in mud, and 15% with a 27.3% grade in sand, as desired.

In addition, the vehicle 100, 200 may contain in one embodiment, an outrigger assembly 400, 500 (see FIGS. 1-4 and 11-12) which are independently controlled linkages that allow the vehicle 100, 200 to be elevated up above the tires 102, 202, or to level the vehicle 100, 200 on uneven terrain, then to lower the vehicle 100, 200. The outrigger assemblies 400, 500 provide stability and rigidity to the vehicle 100, 200 when halted. With a rigid platform, a series of secondary and tertiary functions can be added.

In particular, the outrigger assemblies 400, 500 (see FIGS. 11 and 12) may include at least a vehicle attach point 401, 501, a stabilizer 402, 502, a bi-directional cylinder 403, 503, and a cleat 404, 504.

The vehicle attach point 401, 501 is a weldment that allows the outrigger assembly 400, 500 to be mounted directly onto the vehicle 100, 200.

The stabilizer 402, 502 is the structural weldment that bears the weight of the vehicle 100, 200 as the outrigger assembly 400, 500 is being used.

The bi-directional cylinder 403, 503 provides the power to actually raise and lower the vehicle 100, 200. It is attached to the weldment and stabilizer 402, 502. A valve that directs the flow to perform the desired function of raising or lowering, controls the cylinder 403, 503.

The cleat 404, 504 is a metal swivel, shaped like a square, with four points bent downwards, with a pivot that is independent of the hydraulic cylinder 403, 503. The square with the bent points holds the outrigger in place on the ground. The pivot is simply a pin that allows the square to better hold itself into the ground and provides flexibility to situations where the vehicle 100, 200 is in rough terrain.

The vehicle 100, 200 of the present invention can be modified to provide a number of attachments, whether integrally, or removably, for a variety of purposes. The attachments may be radio/remote-controlled, as desired by the user.

For example, the vehicle 100, 200 may include headlights 108, 208, or floodlights 109, 209 for use in dark environments.

Further, a backhoe 111 (see FIG. 1) can be attached in one embodiment, for road works, or as a bomb detection or landmine detection device 111, for example. The device 111 can be used to dig into the earth a certain number of feet (for example, as much as 10 feet), when digging roadways, or to locate and trigger landmines, for example. The loader on the backhoe device 111, may be used to lift and move the earth, up to 2300 lbs.

Other attachments may include a bucket ranging from 8" to 38", for example, to clear roadways. A quick attach rear bucket allows a change in buckets, and a four wheel drive enables the vehicle 100, 200 to perform well in low traction conditions. Other attachments may include, but are not limited to, rollers, for use in constructing pavements and roads, for example.

Additional attachments may include a PA system 112, 212 (see FIGS. 1-4), which can broadcast various sounds, for example, the sound of a tank, or of marching troops, or verbal announcements or instructions, within a predetermined range from the vehicle 100, 200. Further, the vehicle 100, 200 can also include an alarm 114, 214, which can provide warnings to listeners within a predetermined range or distance (see FIGS. 2 and 4, for example).

In addition, the vehicle 100, 200 may also include a variety of cameras 113, 213 (see FIGS. 1-4), which may be provided in a housing, which can protect the cameras 113, 213. The housing 216 can be retractable such that the cameras 213 are not damaged during use (see FIG. 4, for example).

The cameras 113, 213 may include at least one of a thermal camera (such as an EO Thermovision® A20 camera), a motion camera, a digital camera, near infrared camera (such as a Hitachi Near-IR Camera KP-F2A), etc. The cameras 113, 213 may be controlled remotely by a user using remote control technology, as described above.

In addition, the vehicle 100, 200 can include a remote antenna 115, 215 either internal or external (may be retractable) to the vehicle 100, 200, which can receive signals from a remote control device handled by a user, which can direct the vehicle 100, 200 in any desired direction.

The remote antenna 115, 215 can also include a global positioning system (GPS) which can ensure that the location and direction of the vehicle 100, 200 can be determined remotely by users.

Figure 9:
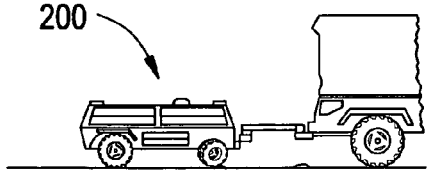
FIG. 9 is a side view of a second embodiment of the vehicle of the present invention being towed.

The vehicle body 100, 200 may also include D-clamps 117, 217 or other devices which may allow the vehicle 100 to be lifted by air transport (see FIGS. 5 and 9) from one location to another.

In addition, a rugged bumper 118, 218 may be provided on the vehicle 100, 200 on at least one end of the body 101, 201, for purposes of a winch or for towing of the vehicle 100, 200 (see FIGS. 2-4, and FIGS. 6, 7 and 9).

Further, strap down rings 119, 219 (see FIGS. 2 and 3, for example) may be provided to hold the vehicle 100, 200 in place on uneven terrain, on a ship, or during strong wind forces, for example.

The vehicle body 101, 201 may also include weaponry, such as rotary cannons 120 (see FIG. 2, for example), machine guns, and other weaponry—whether offensive or defensive, or any other external equipment, which would be useful to a user.

Sensors 121, 221 may be placed on the body 101, 201 of the vehicle 100, 200, for example, to provide readings to the user, whether the user is in the vehicle 100, 200, or handling the vehicle 100, 200 remotely. The sensors 121, 221 may provide readings of motion detection, biological substance detection, chemical substance detection, temperature detection, light detection, etc.

Reflectors 122, 222 may be placed on the vehicle 100, 200 to provide visibility in the dark.

The vehicles 100, 200 can also be provided with HVAC, windshield wiper systems, communication systems, audio and visual systems, and any other systems which would be provided in a commercial vehicle, for example, as desired by the user.

In a second embodiment consistent with the present invention, the vehicle 200 (see FIG. 4), may be rectangular in shape, but may have any suitable shape directed to the purposes for which it is used.

The vehicle 200 may also have sloped sides 203 to better travel through inclement weather (i.e., snow, rain, etc.) or in a military environment to deflect projectiles or small arms weapons fire, for example, to increase protection of the vehicle 200.

In one embodiment consistent with the present invention, the sloped side surfaces 203 can be opened to expose at least one storage facility 204 which can hold supplies, equipment, and if large enough, even personnel. The doors 206 which open to the hold or storage facility 204 can have wide piano hinges, such that there is easy access to storage. As stated above, the vehicle body 201 can also have appliqué armor if used in a military environment.

In one embodiment consistent with the present invention, one end of the vehicle 200 can include drop down or swing doors 211 which can be opened into the storage facility 204 or into a separate storage facility 220 from the storage facility 204. All the doors 206, 211 can be secured with locks or other devices to secure access to the vehicle.

In one embodiment consistent with the present invention, the vehicle body 201 may be designed to be low in profile in order to provide less visibility at night if used in a military environment, for example. With this low profile, the vehicle 200 can be taken into hostile areas and can move around more unobtrusively.

In operation, the vehicle 100, 200 can be used in a military or non-military environment. Non-military uses include commercial uses, such as building of roadways, and expeditions, where supplies and equipment can be carried without burdening the users.

In military uses, the vehicle 100, 200 can be used, for example, to proceed ahead of a troop of soldiers, to scout, using its cameras 113, 213, or provide warnings via an alarm 114, 214 or over a PA system, based on sensor 121, 221 readings, etc., while soldiers are on patrol.

The vehicle 100, 200 can also carry equipment and supplies for the soldiers, and can provide a reference point for communications (which can be included with the vehicle, either internally or externally), and provide electrical power for field use, or any other suitable use in support of a military unit. Since the vehicle 100, 200 can travel ahead of the soldiers, in the event that a landmine or other device is missed by the user viewing remotely via the camera 113, 213, no soldiers would be affected.

Further, since the vehicle 100, 200 is inexpensive to produce and equip, repair and replacement of the vehicle 100, 200 would be easy and cost-effective for the user.

It should be emphasized that the above-described embodiments of the invention are merely possible examples of implementations set forth for a clear understanding of the principles of the invention. Variations and modifications may be made to the above-described embodiments of the invention without departing from the spirit and principles of the invention. All such modifications and variations are intended to be included herein within the scope of the invention and protected by the following claims.

What is claimed is:

1. A motorized military vehicle comprising:

a vehicle body having a rigid, tractor-shaped frame and a personnel enclosure, said tractor-shaped frame having a pair of front wheels and a pair of rear wheels rotatably mounted thereon with corresponding front and rear tires, said rear wheels/tires being larger in diameter than said front wheels/tires;

attachments disposed on the vehicle body that are operable via remote control;

a retractable camera disposed on said vehicle body, the camera being operable via remote control;

a weapon system that is disposed on said vehicle body, wherein the weapon system is adapted to emit solid projectiles that are guided toward an intended target;

a backhoe and loader disposed on said vehicle body and operative to dig into the earth to clear explosives or landmines;

a control system to control the motorized military vehicle;

a control panel that enables a user to access said control system, said control panel comprising a power button, a status button, a track control for controlling forward and reverse movement, and a swing control for controlling left and right movement of said backhoe and loader to aid in explosive or landmine clearance;

a sensor disposed on said vehicle body; and a remote controller which remotely controls the vehicle, wherein the vehicle is operative in a first mode manually by a user positioned within the personnel enclosure, or in a second mode via the remote controller by the user positioned at a location away from the motorized military vehicle, wherein said sensor is operative to provide readings to the user in the first mode when the user is positioned within the personnel enclosure, or in the second mode when the user is controlling the motorized military vehicle remotely, and wherein the remote controller is operative to place the motorized military vehicle in an autonomous mode for clearance of explosives and landmines.

2. The vehicle of claim 1, wherein said vehicle body is armored, the armor comprising appliqué armor applied to the tractor-shaped frame of the vehicle body.

3. The vehicle of claim 1, further comprising: an antenna disposed on said vehicle body.

4. The vehicle of claim 3, wherein said antenna includes a GPS system.

5. The vehicle of claim 1, further comprising: strap down rings disposed on said vehicle body, to fasten the vehicle in place.

6. The vehicle of claim 1, further comprising: an outrigger assembly disposed on said vehicle body, to provide stabilization and rigidity to the vehicle when halted.

7. The vehicle of claim 1, wherein said sensor detects at least one of a biological substance or a chemical substance.

8. The vehicle of claim 1, further comprising: a reflector disposed on said vehicle body.

9. The vehicle of claim 1, further comprising: a PA system disposed on said vehicle body.

10. The vehicle of claim 1, further comprising: an alarm disposed on said vehicle body.

11. The vehicle of claim 1, wherein said retractable camera is one of a motion, thermal, digital, and near infrared camera.

12. The vehicle of claim 1, wherein said retractable camera is retractable into a housing.

13. The vehicle of claim 1, further comprising: an HVAC system.

14. The vehicle of claim 1, wherein said vehicle body includes clamps for air transport.

15. The vehicle of claim 1, wherein the weapon system includes at least one of a rotary cannon or a machine gun.

16. A motorized military vehicle for use in explosives clearance and transportation of personnel and equipment, comprising:

a tractor body having a rigid, tractor-shaped frame and a personnel enclosure, said tractor-shaped frame having a pair of front wheels and a pair of rear wheels rotatably mounted thereon with corresponding front and rear tires, said rear wheels/tires being larger in diameter than said front wheels/tires;

a backhoe with loader disposed on the tractor body, said backhoe with loader which is operative for explosives clearance and earth removal;

a hydrastatic steering system;

a control system to control the vehicle including said hydrastatic steering system;

a control panel that enables a user to access said control system, said control panel comprising a power button, a status button, a track control for controlling forward and reverse movement, and a swing control for controlling left and right movement of said backhoe with loader to aid in explosive or landmine clearance;

a remote control transmitter and receiver, which operate the motorized military vehicle by remote control;

an outrigger assembly having independently controlled linkages to elevate and lower the motorized military vehicle over terrain;

a retractable camera disposed on said tractor body, the camera being operable by said remote control;

a remote antenna including a GPS system for location of the motorized military vehicle;

a weapon system disposed on the vehicle, said weapon system which emits solid projectiles towards an intended target; and a sensor disposed on said vehicle body and which detects at least one of a biological substance or a chemical substance, wherein the vehicle is operative in a first mode manually by a user positioned within the personnel enclosure, or in a second mode via the remote control transmitter and receiver by the user positioned at a location away from the motorized military vehicle, wherein said sensor is operative to provide readings to the user in the first mode when the user is positioned within the personnel enclosure, or in the second mode when the user is controlling the motorized military vehicle remotely, and wherein the remote control transmitter and receiver are operative to place the motorized military vehicle in an autonomous mode for clearance of explosives and landmines.

17. The vehicle of claim 16, wherein said vehicle body is armored, the armor comprising appliqué armor applied to the tractor-shaped frame of the vehicle body.

18. The vehicle of claim 16, further comprising: a communication system disposed within the personnel enclosure for communication between a manual user of the motorized military vehicle and personnel at a location away from the motorized military vehicle.

19. A motorized military vehicle comprising:

a vehicle body having a rigid, tractor-shaped frame;

a personnel enclosure disposed in said vehicle body, said personnel enclosure including a canopy;

a pair of front wheels and a pair of rear wheels rotatably mounted on said vehicle body with corresponding front and rear tires, said wheels having an RPM control which controls a tractive effort and gradability of said vehicle;

an explosives clearing and minesweeping mechanism, disposed on said vehicle body;

a control system to control operation of said vehicle, including a track control for controlling forward and reverse movement, and a swing control for controlling left and right movement of said explosives clearing and minesweeping mechanism;

a remote control system to control operation of said vehicle, including multiple radio channels for said control system, and a power source for said remote control system, wherein the remote control system is operative to place the motorized military vehicle in an autonomous mode for clearance of explosives and landmines;

a transmitter disposed on said vehicle to transmit a signal to said remote control system, and a receiver for receiving said signal at said remote control system;

a motor and hydraulic system for the motorized military vehicle, and a proportional controller including a single component interface and analog proportional inputs for the hydraulic system;

attachments disposed on the vehicle body, said attachments including a remote antenna, an alarm, a retractable camera, a GPS system, a weapon system, and a communications system, said weapon system being disposed on said vehicle body, and said weapon system being operative to emit solid projectiles that are guided toward an intended target; and a sensor disposed on said vehicle body and which detects at least one of a biological substance or a chemical substance, wherein said sensor is operative to provide readings to the user in a first mode when the user is positioned within the personnel enclosure, or in a second mode when the user is controlling the vehicle remotely.

* * * * *